United States Patent [19]

Gessalin

[11] Patent Number: 4,641,382

[45] Date of Patent: Feb. 10, 1987

[54] HELMET FASTENING DEVICE

[76] Inventor: Jean Gessalin, Hameau Grande Fontaine, 77131 Touquin, France

[21] Appl. No.: 642,411

[22] Filed: Aug. 20, 1984

[30] Foreign Application Priority Data

Aug. 19, 1983 [FR] France ..... 83 13579

[51] Int. Cl.[4] ..... A42B 3/02

[52] U.S. Cl. ..... 2/421; 2/6; 2/414

[58] Field of Search ..... 2/421, 10, 6, 411, 424, 2/425, 410, 415, 414

[56] References Cited

U.S. PATENT DOCUMENTS

| | | | |
|---|---|---|---|
| 2,814,043 | 11/1957 | Alesi | 2/421 |
| 3,310,811 | 3/1967 | Iacono, Jr. | 2/6 |
| 3,323,134 | 6/1976 | Swyers . | |
| 3,478,365 | 11/1969 | Varga . . | |
| 3,572,329 | 3/1971 | Woskin | 2/421 |
| 3,748,657 | 7/1973 | Aileo | 2/6 |
| 3,873,997 | 4/1975 | Gooding . | |
| 4,117,553 | 10/1978 | Bay | 2/10 |
| 4,199,823 | 4/1980 | Jenkins et al. | 2/6 X |
| 4,222,123 | 9/1980 | Hellberg | 2/10 |
| 4,290,150 | 9/1981 | Guerre-Berthelot | 2/421 |
| 4,297,747 | 11/1981 | Nava | 2/10 |
| 4,553,270 | 11/1985 | Hoffmann | 2/421 |

FOREIGN PATENT DOCUMENTS

| | | |
|---|---|---|
| 2407679 | 6/1979 | France . |
| 2490466 | 3/1982 | France . |
| 2120081 | 11/1983 | United Kingdom . |

*Primary Examiner*—Werner H. Schroeder
*Assistant Examiner*—Andrew M. Falik
*Attorney, Agent, or Firm*—Sandler & Greenblum

[57] ABSTRACT

A fastening device for protective helmets for motorcyclists and other helmet wearers includes a journalled front chin strap which is integrated with a rear arch. The chin strap pivots on two fixed points located inside of the helmet. The arch also pivots around fixed points inside of the helmet so that the chin strap and arch move synchronously. The means for synchronization includes two fingers located inside the chin strap which engage the rear arch.

6 Claims, 9 Drawing Figures

HELMET FASTENING DEVICE

DESCRIPTION

1. Field of the Invention

The present invention relates to a fastening device for protective helmets for motorcyclists and other helmet wearers.

In particular, the present invention is to provide a fastening device for protective helmets for motorcyclists and other helmet wearers that prevents the helmet from being pulled off a wearer in the event of a shock incident to an accident. It automatically adapts to the head of the wearer and is stabilized in place.

2. Discussion of Background Information

The present invention relates to a fastening device for protective helmets for motorists and others. Until presently, helmet fastening devices consisted of a chin strap that was placed under the chin of a wearer with an adjustment buckle permitting tightening. A chin strap did not prevent the helmet from being pulled off, however, during a violent shock experienced during a fall directed perpendicular to the chin strap. If the chin strap was placed as close as possible to the larynx of the wearer, under considerable tension, the result was discomfort to the user. Additionally, at its anchor points on each side of a helmet, such a chin strap exerts an offset force with respect to the transverse median plane of the cranium of the wearer. This creates a torque that makes a helmet rotate about an axis passing substantially through the ears of a wearer if a shock is imparted to the helmet.

The device according to the present invention overcomes these disadvantages and ensures that the helmet it is attached to fully protects the cranium of a wearer regardless of the stresses that the helmet undergoes during a shock or several successive omni-directional shocks.

SUMMARY OF THE INVENTION

The present invention a helmet fastening device including a journalled front chin strap that pivots on two fixed points located inside the helmet in combination with a rear arch that also pivots about two fixed points located inside the helmet, wherein movement of the chin strap and the rear arch are synchronized and integrated when they pivot by the means of fingers located inside the chin strap that engage oblong slits located in the rear arch.

BRIEF DESCRIPTION OF THE DRAWINGS

In the following drawings of one of the embodiments of the invention, given by way of non-limiting example.

DETAILED DESCRIPTION OF THE INVENTION

Figure 1:
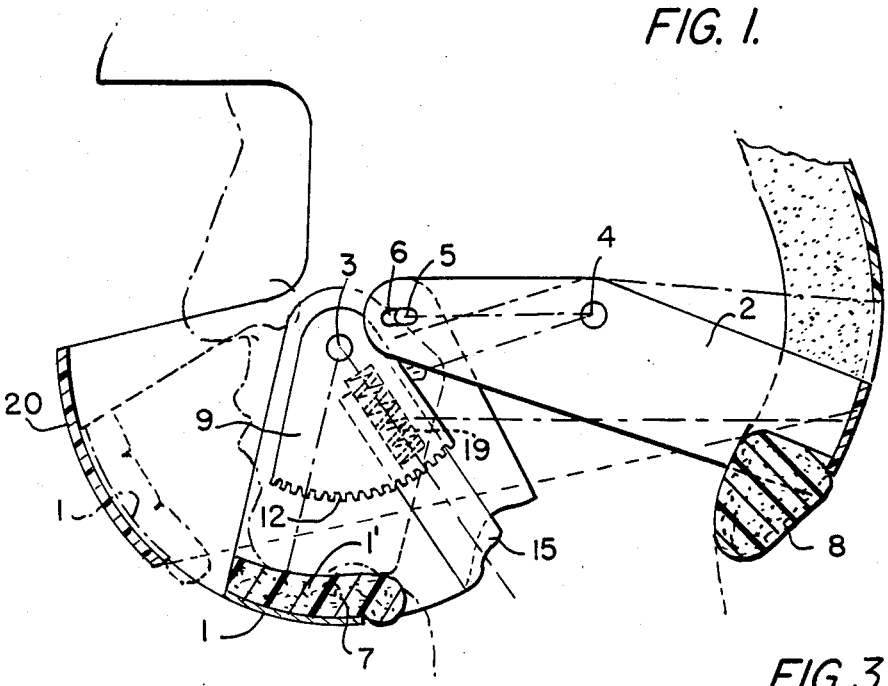
FIG. 1 is a lateral elevational view in cross section to expose the fastener device of the present invention.

The device comprises, as shown in FIG. 1, a front chin strap 1 and a rear arch 2 that pivots on fixed points 3 and 4, respectively. Chin strap 1 pivots on two pins integral with the helmet and located inside the helmet and symmetric with respect to the median plane of the front portion of the helmet.

Figure 2:
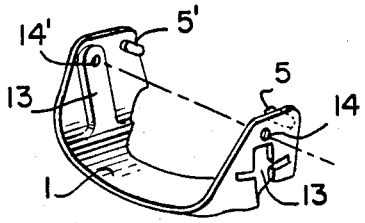
FIG. 2 is a perspective view of the constructive detail of the pivoting chin straps and arch.
Figure 3:
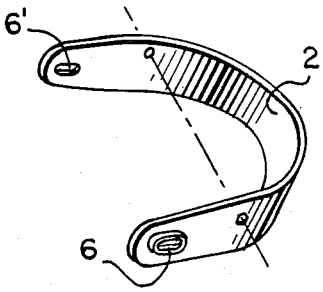
FIG. 3 is another perspective view of the constructive detail of the pivoting chin straps and arch.
Figure 4:
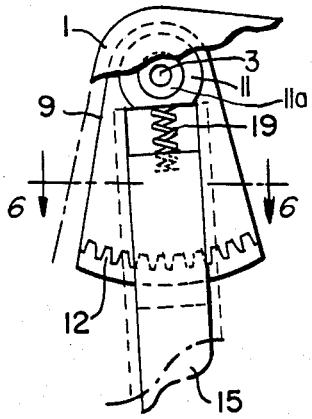
FIG. 4 is an elevational view of the locking device.

Chin strap 1, as shown in FIGS. 1 and 2, further comprises two fingers 5 and 5' that project inwardly and engage two oblong slits 6 located in arch 2. This configuration constitutes a synchronization device that permits rear arch 2 to pivot at a corresponding angle when a stress transmitted to chin strap 1 pivots the chin strap a certain amplitude. Chin strap 1 further comprises, along its inner face, a shock absorbing lining 7 that also serves to take up slack for minute adjustments according to the different morphologies of the user. The rear arch comprises a nape cushion 8 that conforms to the bottom of the nape or neck of a wearer when the chin strap is in place.

The locking device, shown in FIGS. 1, 4, 5, 6, 7 and 8, comprises a toothed sector plate 9, substantially triangular in shape, wherein the top is positioned by means of an opening 10 through which pin 3 is fixed on helmet 20 by means of screw 11 and lug 11*a*. This toothed sector plate 9 is thus rigidly fixed and rendered integral with helmet 20 and is immobilized in rotation by this arrangement. The side opposite the top forms a circular arc of predetermined radius that comprises a toothed rack having a radius corresponding to the radius of the circular arc wherein the teeth are oriented towards the center of the sector plate.

Chin strap 1 comprises on its outer portions grooves 13 and 13' of rectangular cross-section opening downwardly and located in the axis of openings 14 and 14' of the chin strap for receiving pins 3. Slide catches 15 are located in grooves 13 and 13; each comprises at this median portions grooves 16 through half of their thicknesses wherein the upper edges have teeth 17 corresponding to the teeth of racks 12. The lower edges 18 comprise circular arcs having radii corresponding to those of the base of element 9 increased slightly greater than the height of the teeth of racks 12. Each catch 15 in groove 13 is biased by a spring 19. Teeth 17 of catch 15 engage the teeth of rack 12 of sector plate 9 so that chin strap 1 cannot pivot. Rear arch 2, which is integral with chin strap 1, is likewise immobilized.

Figure 5:
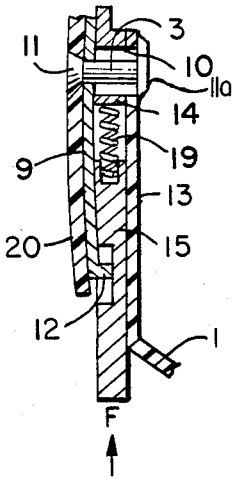
FIG. 5 is a cross-sectional view of the locking device.
Figure 6:
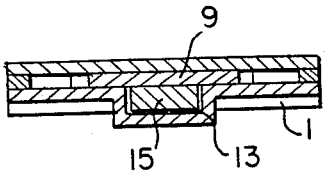
FIG. 6 is a cross-sectional view along line VI—VI of the locking device.
Figure 7:
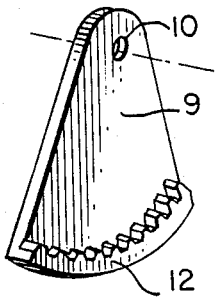
FIG. 7 is a perspective view of the locking-toothed sector plate.
Figure 8:
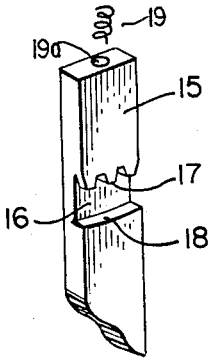
FIG. 8 is a perspective view of the catch.
Figure 9:
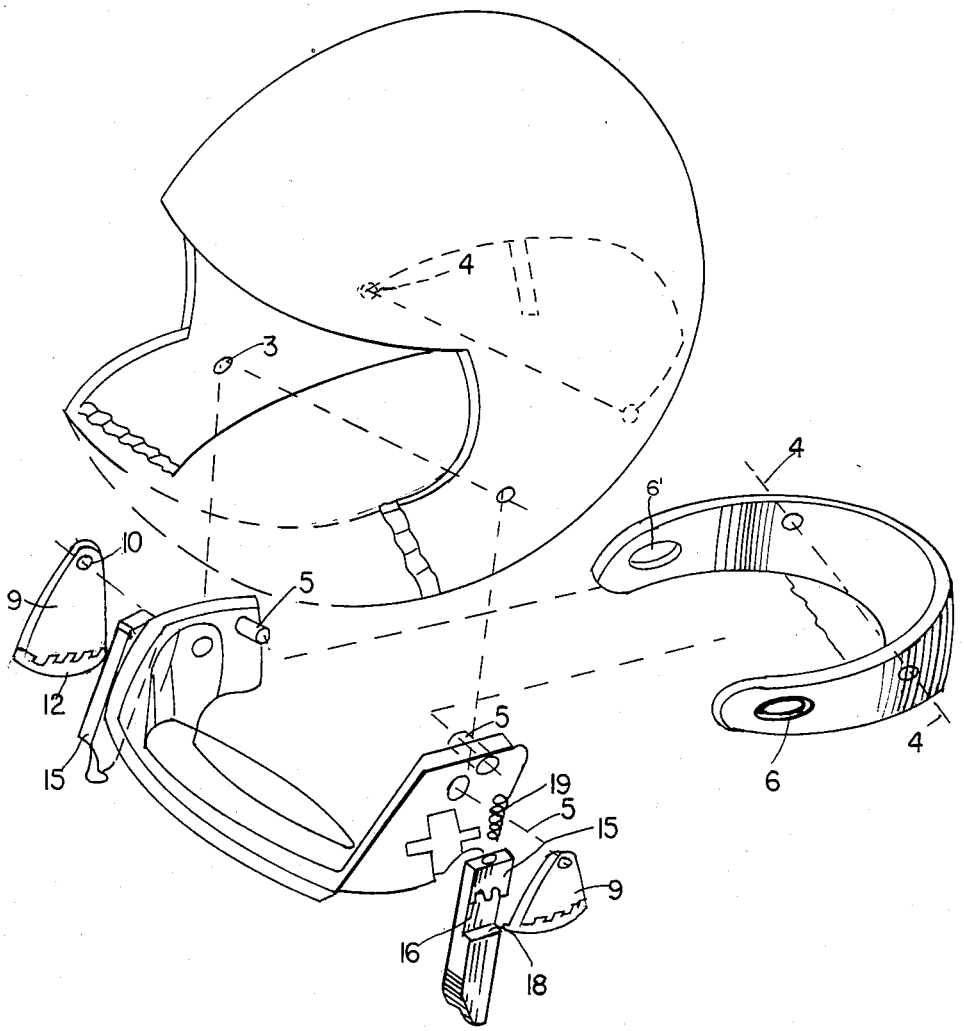
FIG. 9 is an exploded perspective view of the elements seen in FIG. 1.

To freely pivot the two elements 1 and 2, the two catches 15 must be simultaneously pushed along arrow F shown in FIG. 5. In operation, once the helmet is in place on the head of a user, the two catches 15 can be simultaneously pushed along arrow F with the help of two thumbs. While catches 15 are being pushed, pivoting movement transmitted by the hands to chin strap 1 position the helmet on the head of the user. By releasing the pressure of the two thumbs, the retention elements lock the chin strap and rear arch into the chosen position.

To remove the helmet, two thumbs must again press on the two catches 15 to pivot chin strap 1 forwardly. By removing the two thumbs, the retention elements then lock in an open position, enabling a wearer to remove the helmet without the annoyance of a pivoting chin strap and rear arch.

It is obvious that the helmet, once it is fastened, can in no way be pulled off accidentally as the simultaneous action operating on the two catches is necessary to unlock the retention means. If one of the catches is collapsed or one of the locks is destroyed during an accidental shock on one of the sides, the other lock will sufficiently maintain the retention means thus preventing the helmet from being pulled off the head of the wearer. Hence nearly absolute security is provided by this system.

In addition to security, the device prevents all displacement of the helmet with respect to the head and imparts a greater measure of comfort to the wearer. The front opening is always positioned so that the wearer's field of vision remains unobstructed. Finally, this device can be used for so-called "integral" helmets whose opening for the head is a closed oval, as well as for so-called "enveloping" helmets wherein the helmet is completely open on the front portion.

The forms, dimensions, and locations of the various elements can vary within the limits of equivalence as can, moreover, materials used for their manufacture, without changing the general conception of the invention that has been described hereabove.

What is claimed is:

1. A fastening device for a protective helmet for motorcyclists and other helmet wearers wherein said fastening device prevents said helmet from being pulled off a wearer in the event of a shock and ensures that said helmet will be stable when worn by a wearer, said device comprising:

(a) a front chin strap journalled on a first pair of elongate pins extending through the shell of the helmet to project to the inside of said helmet, said chin strap positioned to fit under the chin of a wearer;

(b) a rear arch pivoted on a second, distinct pair of fixed pins located inside said helmet, said arch positioned to rest against a nape of the neck of a wearer; and (c) two fingers located inside said chin strap that engage oblong slots located in said rear arch whereby movement between said chin strap and said rear arch is synchronized.

2. A device defined by claim 1 wherein said chin strap comprises a shock absorbing lining and said rear arch comprises a shock absorbing cushion, said lining and cushion being respectively positioned between the chin of a wearer and said chin strap and the nape of a wearer and said arch.

3. A device defined by claim 1 wherein said fastening device further comprises a plurality of locking mechanisms for preventing movement between said strap and arch and said helmet, each of said mechanisms comprising a toothed sector plate having a centering hole for receiving one of said elongate pins, each of said elongate pins having one end with a screw head exposed on the exterior surface of the said helmet and another end adjustably fitted within a lug attached to said pin strap, so that as said screw head is turned said pin penetrates within said lug to tighten said sector plate between said helmet and said chin strap.

4. A device defined by claim 3 wherein said sector plate further comprises a toothed rack opposite said centering hole and positioned upwardly, wherein said rack has a radius corresponding to the arc described by said sector plate.

5. A device defined by claim 3 wherein said chin strap further comprises two grooves of rectangular cross-section, two openings, and two catches, wherein said two grooves are located along the axis formed by said two openings, and each of said catches comprises two surfaces wherein one of said surfaces comprises teeth and the other of said surfaces comprises an inclined surface inclined at an arc having a radius slightly greater than said radius corresponding to the arc described by said sector plate, wherein said catches are adapted to slide within said grooves and engage said teeth of said racks.

6. A device defined by claim 5 wherein said chin strap further comprises two springs, each spring comprising means for biasing one of said catches into a respective groove and thus comprising means for requiring the exertion of force against said springs to disengage said teeth of said catches from said teeth of said racks and pivot said chin strap about said first pair of fixed points.

* * * * *